US012765728B2

(12) United States Patent
Takaki et al.

(10) Patent No.: US 12,765,728 B2
(45) Date of Patent: Oct. 20, 2026

(54) TOILET SEAT DEVICE AND CLOSET BOWL DEVICE

(71) Applicant: TOTO LTD., Kitakyushu (JP)

(72) Inventors: Takeshi Takaki, Fukuoka (JP); Satoko Kizuka, Fukuoka (JP); Yuta Sakai, Fukuoka (JP); Hirotomo Suyama, Fukuoka (JP); Hitoaki Higuchi, Fukuoka (JP); Naoya Takeuchi, Fukuoka (JP); Haruna Kawasaki, Fukuoka (JP); Ryo Oi, Fukuoka (JP); Yusuke Motoda, Fukuoka (JP); Yo Morotomi, Fukuoka (JP)

(73) Assignee: TOTO LTD., Kitakyushu (JP)

( * ) Notice: Subject to any disclaimer, the term of this patent is extended or adjusted under 35 U.S.C. 154(b) by 66 days.

(21) Appl. No.: 18/590,992

(22) Filed: Feb. 29, 2024

(65) Prior Publication Data

US 2024/0197124 A1 Jun. 20, 2024

Related U.S. Application Data

(63) Continuation of application No. PCT/JP2021/035692, filed on Sep. 28, 2021.

(51) Int. Cl.
*A47K 13/30* (2006.01)
*E03D 11/13* (2006.01)

(52) U.S. Cl.
CPC ..... *A47K 13/305* (2013.01); *E03D 11/13* (2013.01)

(58) Field of Classification Search
CPC ..... A47K 13/30; A47K 13/305
See application file for complete search history.

(56) References Cited

U.S. PATENT DOCUMENTS 10,570,599 B2 * 2/2020 Nogoshi ..... E03D 9/00
11,298,112 B2 * 4/2022 Kashyap ..... G01N 33/493
(Continued)

FOREIGN PATENT DOCUMENTS

JP 2007-054456 3/2007
JP 2010-233925 10/2010
(Continued)

OTHER PUBLICATIONS

International Search Report and Written Opinion for International Application Serial No. PCT/JP2021/035692 mailed on Nov. 9, 2021 8 pages.
(Continued)

*Primary Examiner* — Erin Deery
(74) *Attorney, Agent, or Firm* — Amin, Turocy & Watson, LLP

(57) ABSTRACT

A toilet seat device according to an embodiment is a toilet seat device configured to be attached to an upper part of a closet bowl on which a bowl part for receiving excrement is formed, and includes: a toilet seat upper plate constituting a seating surface on which a user sits; a toilet seat bottom plate joined with the toilet seat upper plate to be opposed to an upper part of the closet bowl; a heating device disposed between the toilet seat upper plate and the toilet seat bottom plate to heat the toilet seat upper plate; and a detection device disposed on the toilet seat to optically detect the excrement. The detection device is arranged in a non-contact manner with respect to the heating device.

7 Claims, 8 Drawing Sheets

(56) References Cited

U.S. PATENT DOCUMENTS

| | | | | |
|---|---|---|---|---|
| 2016/0374619 | A1* | 12/2016 | Borkholder ..... | A61B 5/318<br>600/301 |
| 2018/0087969 | A1 | 3/2018 | Hall et al. | |

FOREIGN PATENT DOCUMENTS

| | | | | |
|---|---|---|---|---|
| JP | 2011-212088 | | 10/2011 | |
| JP | 2017-042384 | | 3/2017 | |
| JP | 2018-146244 | | 9/2018 | |
| JP | 6587222 | | 10/2019 | |
| JP | 2021-036976 | | 3/2021 | |
| WO | WO-2005074777 | A1 * | 8/2005 | ..... G05D 23/30 |

OTHER PUBLICATIONS

Notice of Reasons for Refusal for corresponding Japanese Patent Application No. 2022-540798 dated Nov. 29, 2022.

* cited by examiner

TOILET SEAT DEVICE AND CLOSET BOWL DEVICE

CROSS-REFERENCE TO RELATED APPLICATION (S)

This application is a Continuation of International Application No. PCT/JP2021/035692, filed on Sep. 28, 2021, the entire contents of which are incorporated herein by reference.

FIELD

An embodiment disclosed herein relates to a toilet seat device and a closet bowl device.

BACKGROUND

In the related art, there is known a toilet seat device including a detection device that can detect excrement excreted in a toilet bowl (for example, refer to Japanese Patent Application Laid-open No. 2018-146244).

The detection device used for the toilet seat device disclosed in Japanese Patent Application Laid-open No. 2018-146244 includes a light emitting part that can emit infrared light to excrement, and a light receiving part that can receive reflected light from the excrement. A state of health of a user can be estimated based on information about the excrement detected by the detection device. The detection device is disposed in the toilet seat so that the user does not recognize that excrement of himself/herself is detected.

In a case in which a toilet seat device has a heating function, a heating device is disposed in a toilet seat, the heating device that is used for heating such as a heater for heating the toilet seat and actively heats the toilet seat. However, in a case in which the detection device for optically detecting excrement is arranged in a small device such as a toilet seat as in the toilet seat device disclosed in Japanese Patent Application Laid-open No. 2018-146244, heat generated by the heating device may adversely affect the detection device. For example, in a case of using an appliance having low durability against heat as the detection device, deterioration or damage of the appliance is caused when heat is repeatedly generated by the heating device. Additionally, in a case of trying to acquire various kinds of information about excrement such as a color and a shape of the excrement in addition to presence/absence of excrement by the detection device, optical information acquired by the detection device is required to have predetermined accuracy. However, in a case in which a degree of heat generation by the heating device is different depending on appropriate adjustment by the user or the like, a thermal effect on the detection device is not necessarily stabilized, so that fluctuations and variations may be caused in accuracy in one time of detection of excrement, or accuracy in continuous detection over time.

A toilet seat device according to an aspect of an embodiment, configured to be attached to an upper part of a closet bowl on which a bowl part for receiving excrement is formed, the toilet seat device comprising: a toilet seat upper plate constituting a seating surface on which a user sits; a toilet seat bottom plate joined with the toilet seat upper plate to be opposed to the closet bowl; a heating device disposed between the toilet seat upper plate and the toilet seat bottom plate to heat the toilet seat upper plate; and a detection device disposed on the toilet seat to optically detect the excrement, wherein the detection device is arranged in a non-contact manner with respect to the heating device.

In a toilet seat device according to an aspect of an embodiment, a heating device disposed between a toilet seat upper plate and a toilet seat bottom plate and a detection device disposed in a toilet seat are arranged in a non-contact manner. Due to this, it is possible to reduce the possibility that the heat generated by the heating device adversely affects the detection device.

In the present embodiment, "in a non-contact manner" means that the heating device and the detection device are arranged to be separated from each other by a predetermined distance to reduce the possibility that a thermal effect caused by heat generation by the heating device is applied to the detection device. That is, even if a heating wire of the heating device is coated by heat-resistant resin (for example, rigid polyvinyl chloride) or the like, this state does not mean that "the heating device is arranged "in a non-contact manner" with respect to the detection device".

The toilet seat device according to an aspect of an embodiment, comprising heat transfer suppressing means configured to suppress transfer of heat generated by the heating device to the detection device.

The toilet seat device according to an aspect of the embodiment has heat transfer suppressing means for suppressing transfer of heat generated by the heating device to the detection device, so that it is possible to reduce the possibility that the heat generated by the heating device adversely affects the detection device.

The toilet seat device according to an aspect of an embodiment, wherein the heat transfer suppressing means is constituted of an insulating material having an insulating function, and the insulating material is arranged between the heating device and the detection device. In the toilet seat device according to an aspect of the embodiment, an insulating material is arranged between the heating device and the detection device, so that it is possible to reduce the possibility that the heat generated by the heating device adversely affects the detection device.

The toilet seat device according to an aspect of an embodiment, wherein a clearance is disposed between the insulating material and the heating device, and between the insulating material and the detection device. For example, to prevent the heat from the heating device from being easily transferred to the detection device, it is preferable to dispose a clearance (a layer of air) between the heating device and the insulating material that is arranged between the heating device and the detection device to also prevent the heat from the heating device from being directly transferred to the insulating material. At this point, to prevent the heat from the heating device from being directly transferred to the insulating material, the insulating material may be arranged at a position abutting on the detection device to secure the size of the clearance as large as possible. However, in a case of employing the configuration as described above, the insulating material and the detection device according to the present invention are installed in the toilet seat, so that, when a person sits on the toilet seat, the toilet seat may be bent due to the weight of the person, and the insulating material may abut on the detection device to generate a strange sound unintended by a designer. Thus, by also disposing a clearance between the insulating material and the detection device, in the toilet seat device according to an aspect of the embodiment, it is possible to suppress transfer of the heat from the heating device to the insulating material and the detection device while reducing the possibility that a strange sound is generated at the time when the toilet seat is used.

The toilet seat device according to an aspect of an embodiment, wherein the heating device is not disposed right above the detection device, but heat transfer means is disposed right above the detection device, and the heat transfer means abuts on the heating device.

In the toilet seat device according to an aspect of the embodiment, the heating device is not disposed right above the detection device, so that the heat from the heating device is difficult to be transferred to the detection device, and the possibility that the detection device is deteriorated or damaged can be reduced. At this point, the heating device is not disposed right above the detection device, so that a toilet seat surface is difficult to be warmed up, and there is the possibility that a user sitting on the toilet seat may feel partially cold. Thus, by disposing heat transfer means for indirectly transferring the heat from the heating device to the outside right above the detection device, a corresponding point of the toilet seat is prevented from becoming cold.

The toilet seat device according to an aspect of an embodiment, wherein the detection device is arranged so that part of the detection device projects from the toilet seat bottom plate and the rest of the detection device is embedded inside the toilet seat. In the toilet seat device according to an aspect of the embodiment, part of the detection device projects from the toilet seat bottom plate and the rest of the detection device is embedded inside the toilet seat, so that the distance between the heating device and the detection device can be sufficiently long. Due to this, it is possible to reduce the possibility that the heat generated by the heating device adversely affects the detection device.

The toilet seat device according to an aspect of an embodiment, wherein a length in a height direction of the part of the detection device embedded inside the toilet seat is shorter than a distance between the heating device and the detection device. With the toilet seat device according to an aspect of the embodiment, it is possible to prevent the detection device from being broken by the heating device even in a case in which the detection device is embedded inside the toilet seat.

A closet bowl device according to an aspect of an embodiment, comprising: a rim water discharge port configured to discharge washing water along a rim part of the closet bowl; the closet bowl; and the toilet seat device according to an aspect of an embodiment attached to an upper part of the closet bowl.

The closet bowl device according to an aspect of an embodiment, wherein the detection device is arranged at a position not opposed to the rim water discharge port.

In the closet bowl device according to an aspect of the present embodiment, the detection device is arranged at a position not opposed to a rim water discharge port, so that it is possible to reduce the possibility that the detection device is adversely affected because washing water discharged from the rim water discharge port splashes on the detection device.

The closet bowl device according to an aspect of an embodiment, wherein the detection device is arranged on an inner side than an inner periphery of the rim part.

In the closet bowl device according to an aspect of the present embodiment, the detection device is arranged on an inner side than an inner periphery of a rim part, so that it is possible to cause part of the detection device to project toward a lower side than an upper surface of a closet bowl. That is, the distance between the heating device and the detection device can be sufficiently long. Due to this, it is possible to reduce the possibility that the heat generated by the heating device adversely affects the detection device.

SUMMARY

It is an object of the present invention to at least partially solve the problems in the conventional technology.

The above and other objects, features, advantages and technical and industrial significance of this invention will be better understood by reading the following detailed description of presently preferred embodiments of the invention, when considered in connection with the accompanying drawings.

BRIEF DESCRIPTION OF DRAWING (S)

DESCRIPTION OF EMBODIMENT (S)

The following describes an embodiment of a toilet seat device and a closet bowl device disclosed herein in detail with reference to the attached drawings. The present invention is not limited to the following embodiment.

1. Configuration of Closet Bowl Device

Figure 1:
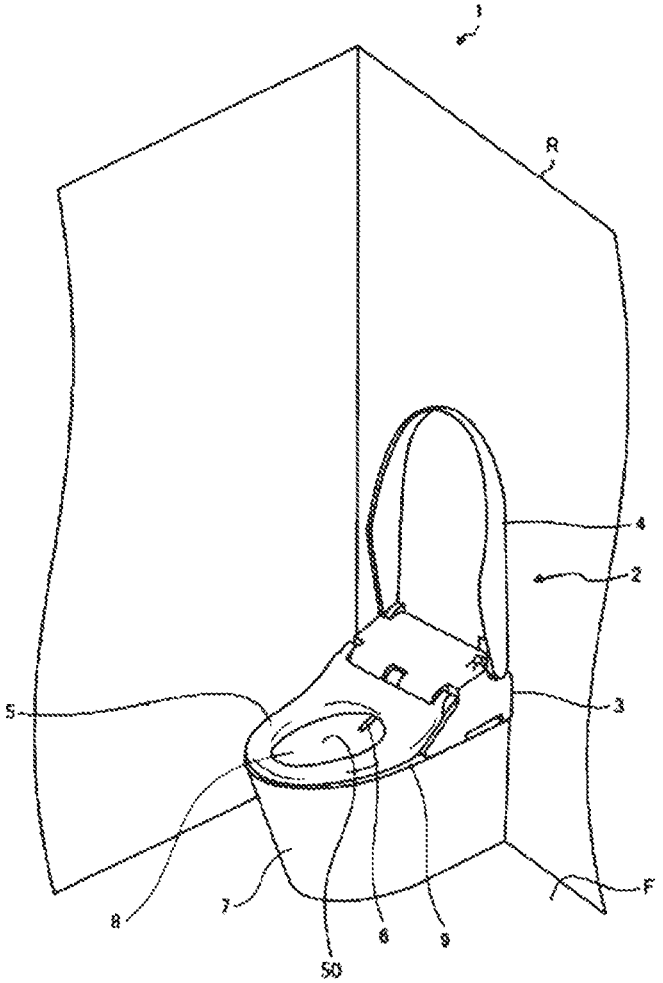
FIG. 1 is a perspective view illustrating an example of a configuration of a closet bowl device according to an embodiment of the present invention.
Figure 2:
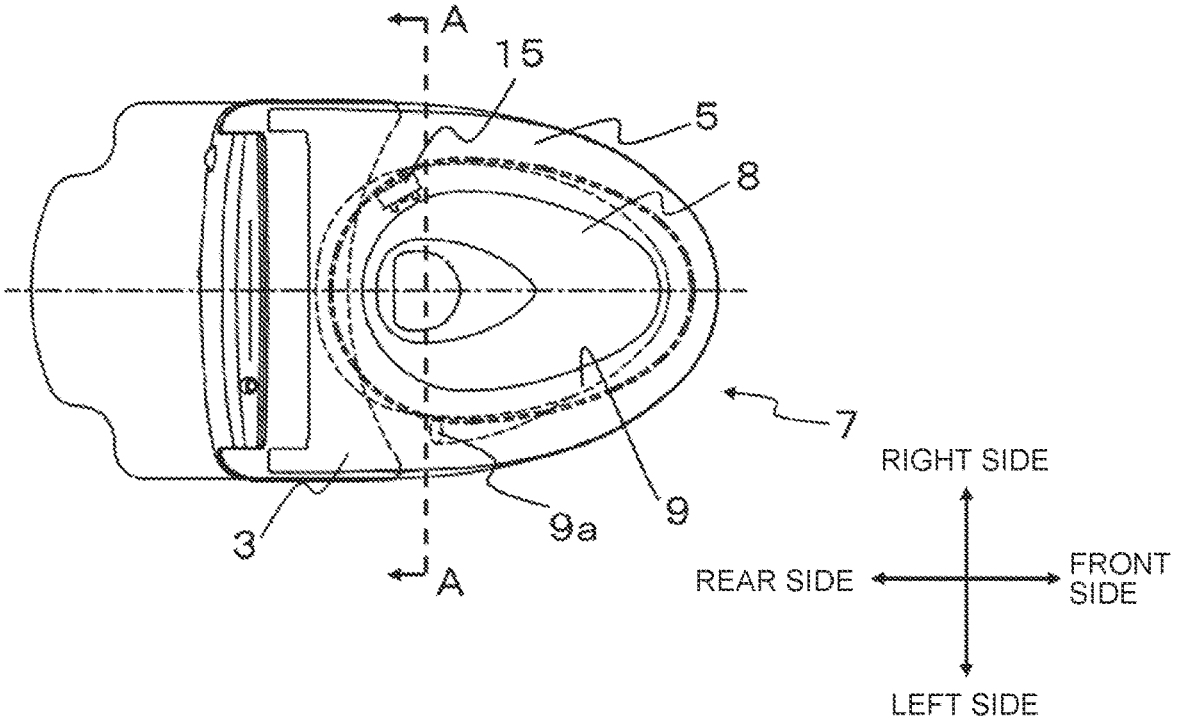
FIG. 2 is a top view illustrating an example of the configuration of the closet bowl device according to the embodiment of the present invention.

First, the following describes a configuration of the closet bowl device according to the embodiment of the present invention with reference to FIG. 1 and FIG. 2. FIG. 1 is a perspective view illustrating an example of the configuration of the closet bowl device according to the embodiment. FIG. 2 is a top view illustrating an example of the configuration of the closet bowl device according to the embodiment.

As illustrated in FIG. 1, a closet bowl device 1 includes a toilet seat device 2 and a Western-style closet bowl (hereinafter, referred to as a "toilet bowl") 7. As illustrated in FIG. 1, the toilet bowl 7 is installed on a floor surface F of a toilet room R. Hereinafter, a direction from the floor surface F toward the inside of a space of the toilet room R is referred to as an upper direction.

The toilet bowl 7 is, for example, made of pottery. A bowl part 8 is formed on the toilet bowl 7. The bowl part 8 is a part having a shape depressed downward, and configured to receive excrement excreted by a user. The toilet bowl 7 is not limited to a floor-standing type as illustrated in the drawing, but may be a wall-hanging type. A washing water tank for storing washing water may be installed on a rear upper part of the toilet bowl 7, or the toilet bowl 7 may be what is called a tankless type, that is, the washing water tank is not installed.

A rim part 9 is formed at an upper edge of the toilet bowl 7. An upper surface of the rim part 9 faces a back surface of a toilet seat 5 in a closed state. A rim water discharge port 9*a* (refer to FIG. 2) is disposed at the rim part 9. The rim water discharge port 9*a* discharges washing water into the bowl part 8 along an inner peripheral surface of the rim part 9, the washing water for discharging excrement of the user to the outside of the toilet bowl 7.

For example, when the user operates a washing operation part (not illustrated) for washing disposed in the toilet room R, toilet bowl washing is performed to supply washing water into the bowl part 8 from the rim water discharge port 9*a*. Due to this, a surface of the bowl part 8 is washed, and the excrement of the user is discharged from the inside of the bowl part 8.

The toilet seat device 2 is attached to an upper part of the toilet bowl 7, and includes a functional part 3, a toilet lid 4, and the toilet seat 5. The toilet seat device 2 may be attached to the toilet bowl 7 in a detachable manner, or may be attached integrally with the toilet bowl 7.

The toilet seat device 2 has a mechanism for executing a heating function for warming up buttocks of the user sitting on the toilet seat 5, and a mechanism for executing an excrement detection function. The excrement detection function is a function of detecting excrement (especially feces) excreted by the user sitting on the toilet seat 5 of the toilet seat device 2, and acquiring information about the excrement. The information about the excrement indicates presence/absence of the excrement and properties (a shape, a size, hardness, a color, and the like) of the excrement. The excrement detection function may also have a function of detecting presence of toilet paper or foreign substances in addition to the excrement. Processing performed by a control device provided in the functional part 3 and configurations provided in the toilet seat 5 to execute the heating function and the excrement detection function will be described later.

The toilet seat device 2 may also have a mechanism for executing a sanitary washing function. That is, the toilet seat device 2 may have a configuration including a water discharge nozzle 6 configured to jet water toward buttocks or the like of the user sitting on the toilet seat 5. The toilet seat device 2 may also have a mechanism for executing a warm-air drying function or a deodorizing function. That is, the toilet seat device 2 may have a configuration including an air blowing unit configured to blow warm air against buttocks or the like of the user sitting on the toilet seat 5, or a deodorizing unit configured to draw in air in the bowl part 8.

The toilet seat 5 is formed in a ring shape having an opening 50 at the center, and arranged to cover part of an opening formed on an upper side of the bowl part 8 along the upper surface of the rim part 9. That is, the toilet seat 5 has a shape partially projecting toward an inner side with respect to an inner periphery of the rim part 9. The toilet seat 5 functions as a seating part that supports buttocks of the sitting user.

One end part of each of the toilet lid 4 and the toilet seat 5 is pivotally supported by the functional part 3, and attached thereto be able to rotate (able to be opened or closed) about a pivotally supporting portion of the functional part 3. The toilet lid 4 in a closed state can cover an upper part of the toilet seat 5. The toilet lid 4 is attached to the toilet seat device 2 as needed, and the toilet seat device 2 does not necessarily include the toilet lid 4.

2. Configuration of Toilet Seat Device

Figure 3:
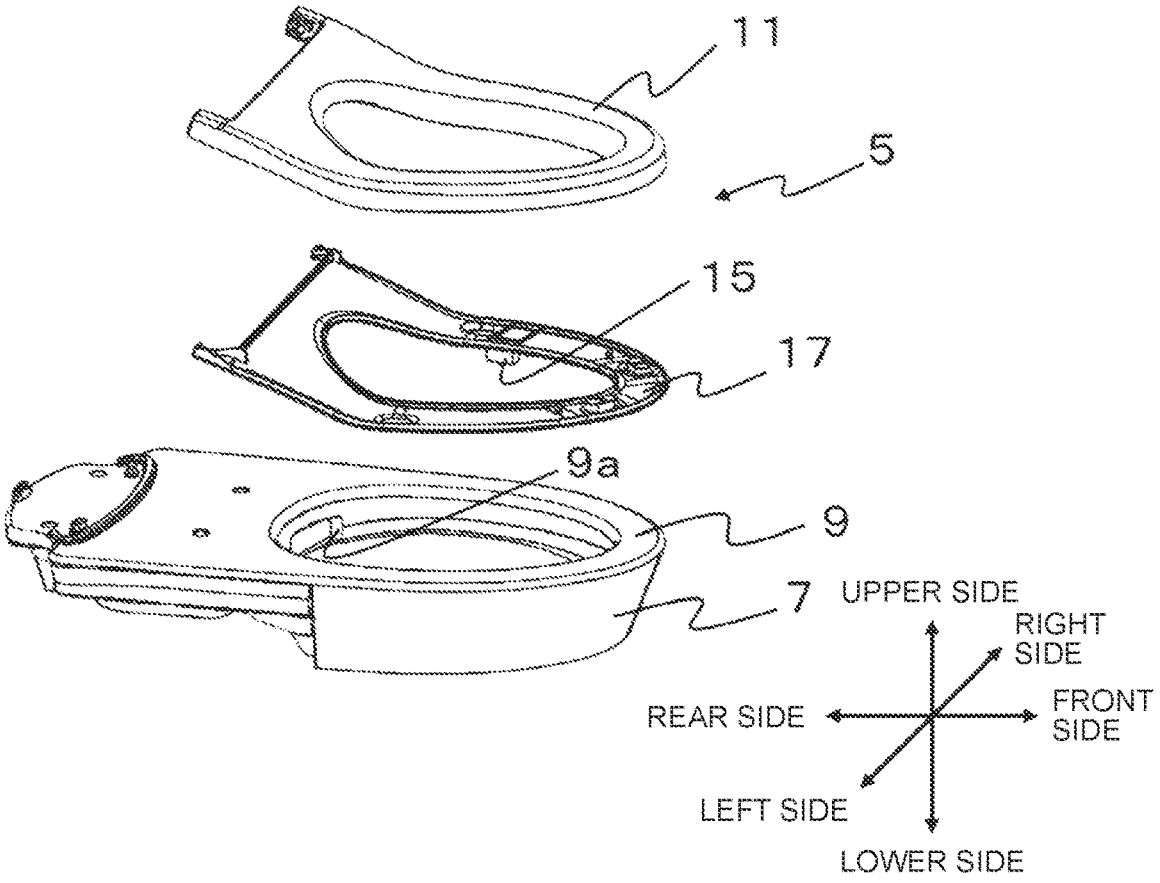
FIG. 3 is an exploded perspective view illustrating an example of a configuration of a toilet seat device according to the embodiment of the present invention.
Figure 4:
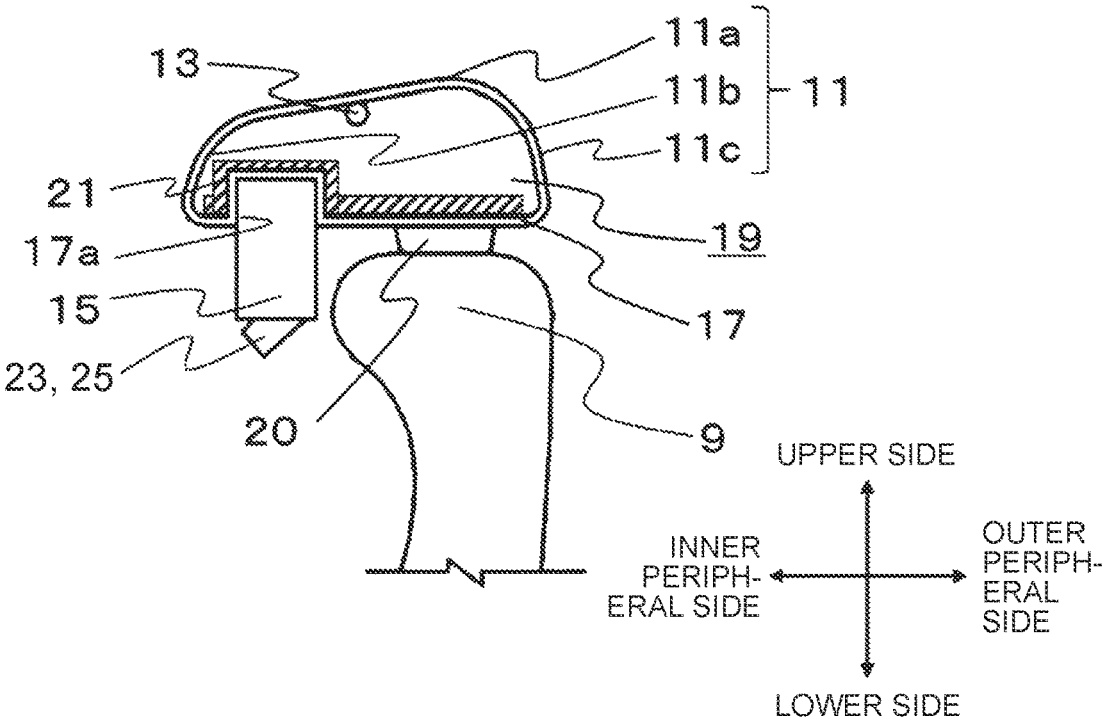
FIG. 4 is an enlarged view of a cross section viewed along the line A-A in FIG. 2.
Figure 5:
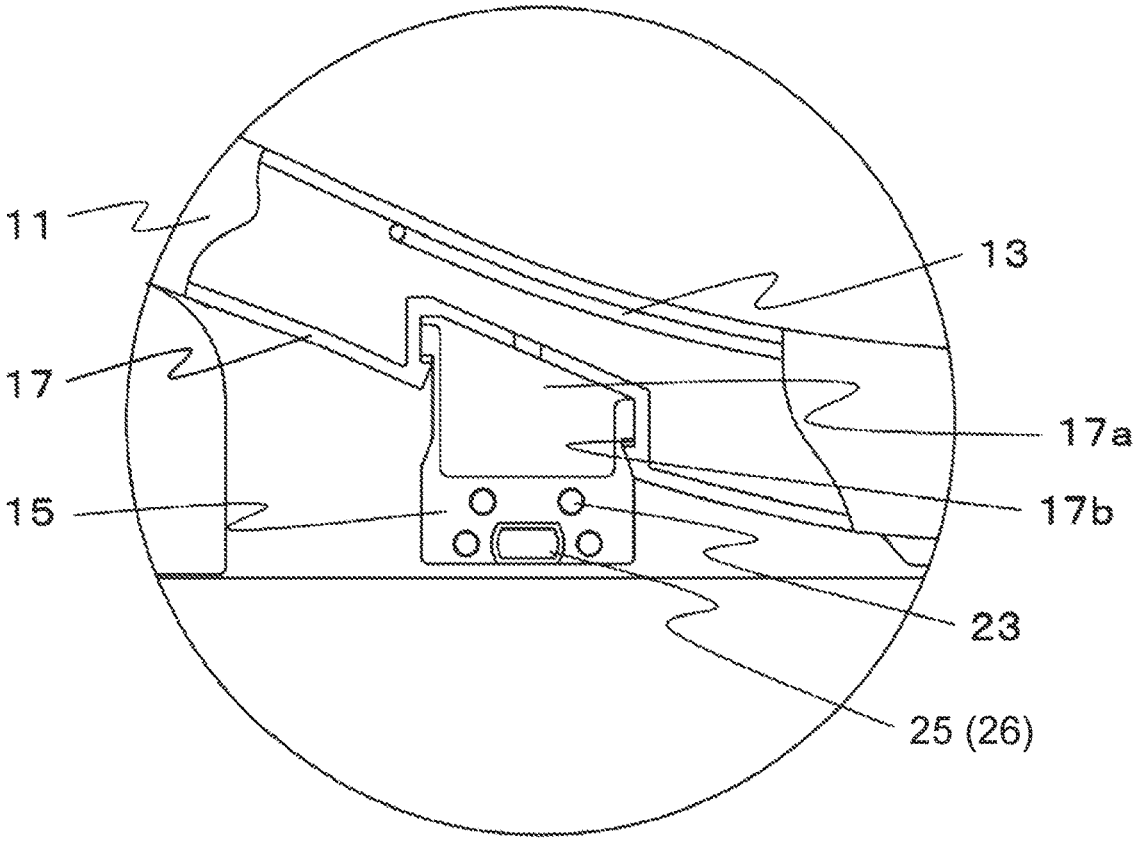
FIG. 5 is a partially enlarged view of FIG. 4.

Next, the following describes a configuration of the toilet seat device according to the embodiment of the present invention with reference to FIG. 3 to FIG. 5. FIG. 3 is an exploded perspective view illustrating an example of the configuration of the toilet seat device according to the embodiment. FIG. 4 is an enlarged view of a cross section viewed along the line A-A in FIG. 2. FIG. 5 is a partially enlarged view of FIG. 4.

As illustrated in FIG. 3 and FIG. 4, the toilet seat 5 includes a toilet seat upper plate 11, a heating device 13, a detection device 15, and a toilet seat bottom plate 17 in this order from an upper side. The heating device 13 and the detection device 15 are arranged in a cavity part 19 that is formed between the toilet seat upper plate 11 and the toilet seat bottom plate 17. That is, the toilet seat 5 includes the heating device 13 for executing the heating function and the detection device 15 for executing the excrement detection function therein. Additionally, the toilet seat 5 preferably includes heat transfer suppressing means 21 between the heating device 13 and the detection device 15.

The toilet seat 5 is formed by joining the toilet seat upper plate 11 with the toilet seat bottom plate 17 by a fusion bonding method such as vibration fusion bonding. Alternatively, the toilet seat 5 may be formed by the toilet seat upper plate 11 and the toilet seat bottom plate 17 engaging with each other. The toilet seat upper plate 11 and the toilet seat bottom plate 17 are, for example, made of thermoplastic resin such as Fiber Reinforced Plastics (FRP) or polypropylene (PP).

As illustrated in FIG. 4, the toilet seat upper plate 11 includes a seating part 11*a* constituting a seating surface (an upper surface of the toilet seat) formed in a ring shape and inclined obliquely downward toward the bowl part 8 side of the toilet bowl, an inner peripheral part 11*b* extending downward from an inner edge of the seating part 11*a*, and an outer peripheral part 11*c* extending downward from an outer edge of the seating part 11*a*. The toilet seat upper plate 11 is formed so that a thickness of the seating part 11*a* is smaller than that of the inner peripheral part 11*b* and the outer peripheral part 11*c* to quickly transfer heat generated by the heating device 13 to the seating surface.

As illustrated in FIG. 4, the heating device 13 is arranged on a back surface of the seating part 11*a* in the cavity part 19. For example, the heating device 13 is a heat transfer wire (heater) or the like that generate heat. The heating device 13 may be a heater that generates heat in accordance with an energization amount controlled by a control device (not illustrated) disposed in the functional part 3. Heat transfer means (not illustrated) is a soaking body that is disposed on the back surface of the seating part 11*a*, and uniformly transfers heat from the heater to the seating part 11*a*. For example, the heater is extended over substantially the entire region of the back surface of the seating part 11*a* via the soaking body, and warms up the toilet seat 5 from the inner side. The heat transfer means is, for example, a metallic member such as aluminum. Herein, the heating device 13 is not disposed right above the detection device 15, but the heat transfer means is disposed right above the detection device 15, and the heat transfer means abuts on the heating device 13 (heating means). In the example of FIG. 4, the heating device 13 is not disposed at a part of the back surface of the seating part 11*a* above the detection device 15, but the heat transfer means (soaking body) is disposed. For example, the heating device 13 is not disposed at a part of the back surface of the seating part 11*a* facing an upper surface of the detection device 15, but the heat transfer means (soaking body) is disposed.

As the heater, what is called a tubing heater, a sheathed heater, a halogen heater, a carbon heater, and the like may be used. A shape of the heater may be any of a wire shape, a sheet shape, a mesh shape, and the like.

The soaking body is made of metallic foil and the like having high thermal conductivity such as aluminum or copper.

In the present embodiment, described is a case of using a resistance heating method as the heating device 13. However, as the heating device 13, an induction heating method for performing heating by electromagnetic induction may be used, for example.

As illustrated in FIG. 4, the detection device 15 is arranged in a non-contact manner with respect to the heating device 13 in the cavity part 19. Due to this, it is possible to reduce the possibility that the heat generated by the heating device 13 adversely affects the detection device 15. A detailed structure of the detection device 15 will be described later in detail in the description about FIG. 6.

The toilet seat bottom plate 17 is a bottom plate constituting a lower surface of the toilet seat 5. As illustrated in FIG. 4, a toilet seat cushion 20 is attached to the toilet seat bottom plate 17, the toilet seat cushion 20 that supports the toilet seat 5 by being in contact with the upper surface of the toilet bowl 7 in a state in which the toilet seat 5 is closed. As illustrated in FIG. 4, a recessed part 17*a* is formed on the toilet seat bottom plate 17 so that part of the detection device 15 can project downward from the toilet seat bottom plate 17. The recessed part 17*a* is sealed by a gasket or the like to prevent moisture from entering the toilet seat 5 from the outside.

With the recessed part 17*a*, it is possible to prevent the toilet seat bottom plate 17 from being deformed by a load that is generated when the user sits on the toilet seat 5. That is, the recessed part 17*a* can reinforce a part around the detection device 15, so that it is possible to suppress the possibility that an adverse effect is caused such that the detection device 15 is damaged or detection accuracy is lowered due to misalignment of the detection device 15 in accordance with deformation of the toilet seat bottom plate 17.

As illustrated in FIG. 4, the heat transfer suppressing means 21 is disposed between the heating device 13 and the detection device 15 in the cavity part 19. For example, the heat transfer suppressing means 21 is an insulating material disposed between the heating device 13 and the detection device 15. For example, the insulating material is a resin plate or a metallic plate, more preferably, a foam heat insulating member such as urethane having an excellent insulating property. The heat transfer suppressing means 21 is formed of a vacuum heat insulating material that reduces heat conduction by gas by causing a periphery to be in a vacuum state, a fibrous heat insulating material (glass wool, rock wool, and the like) that reduces heat conduction by physical and chemical properties, or a foamed heat insulating material (urethane foam, polystyrene foam, and the like). Thus, the heat transfer suppressing means 21 can reduce the possibility that the heat generated by the heating device 13 adversely affects the detection device 15.

The heat transfer suppressing means 21 formed of the foamed heat insulating material is inexpensive, but may be burned in a case in which abnormal heat generation is caused due to breaking of the heater as the heating device 13. Thus, the heat transfer suppressing means 21 is preferably arranged to be separated from the heating device 13 by a predetermined distance in a non-contact manner. Furthermore, the heat transfer suppressing means 21 is preferably arranged to be in contact with the back surface of the toilet seat bottom plate 17. Due to this, the heat generated by the heating device 13 can be prevented from being dissipated toward the toilet seat bottom plate 17 side, so that a time until the heat generated by the heating device 13 is transferred to the seating part 11*a* can be shortened, and energy can be saved. The heat transfer suppressing means 21 described above is merely an example. For example, the heat transfer suppressing means may be formed of a bottom plate having lower thermal conductivity than that of the toilet seat upper plate 11.

3. Configuration of Detection Device

Figure 6:
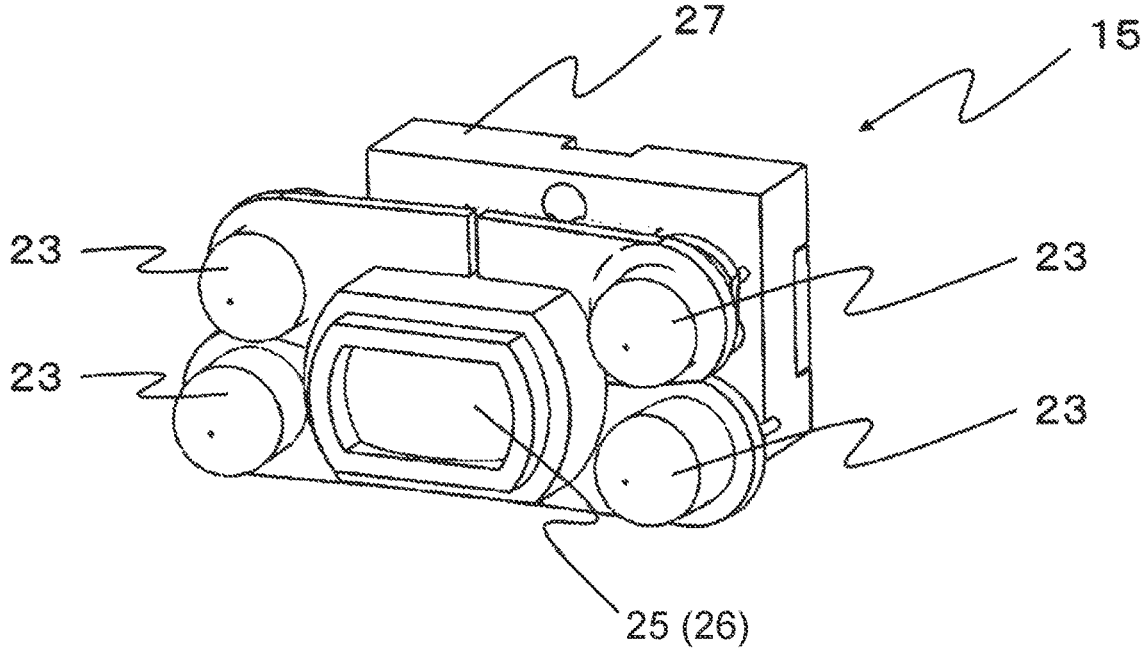
FIG. 6 is a diagram illustrating an example of a configuration of a detection device according to the embodiment of the present invention.

Next, the following describes a configuration of the detection device with reference to FIG. 6. FIG. 6 is a diagram illustrating an example of the configuration of the detection device according to the embodiment of the present invention. The configuration of the detection device 15 illustrated in FIG. 6 is merely an example. The detection device is, for example, constituted of lens, a light receiving sensor, a light emitting part (LED or the like), and a housing that accommodates them.

As illustrated in FIG. 6, the detection device 15 includes light emitting parts 23 configured to emit light in response to an electric signal controlled by a control device (not illustrated) disposed in the functional part 3, a light receiving part 25 configured to receive reflected light from the excrement of the user corresponding to the light emitted by the light emitting part 23, and a housing 27 for supporting the light emitting part 23 and the light receiving part 25. The detection device 15 detects the excrement (especially feces) excreted by the user, and acquires data related to the excrement. The detection device 15 detects, for example, data related to presence/absence of the excrement and properties (a shape, a size, hardness, a color, and the like) of the excrement. Processing performed by the functional part 3 on the data detected by the detection device 15 will be described later.

The light emitting part 23 includes, for example, a light emitting element (not illustrated) such as a light emitting diode (LED). The light emitting element included in the light emitting part 23 is not limited to the LED, and various elements may be used. The light emitted from the light emitting part 23 is not limited to white light having a uniform wavelength of a visible ray, but may be colored light having only a specific wavelength or invisible light such as an infrared ray.

The light receiving part 25 includes a lens 26 and a light receiving element (not illustrated). The light receiving element is formed of a line sensor or an area sensor in which charge coupled device (CCD) sensors or complementary metal oxide semiconductor (CMOS) sensors are arranged, for example. The light receiving part may have a configuration including a spectral function such as a spectral filter.

The present embodiment describes an aspect in which the light emitting part 23 and the light receiving part 25 are supported by the same housing 27, in other words, an aspect of the detection device 15 in which the light emitting part 23 is integrated with the light receiving part 25. However, the detection device 15 may have an aspect in which the light emitting part 23 and the light receiving part 25 are respectively supported by different housings 27, in other words, an aspect in which the light emitting part 23 and the light receiving part 25 are separately arranged, and functions thereof execute the function of the detection device 15.

The light emitting part 23 and the light receiving part 25 may be adversely affected by heat generation by the heating device 13. Specifically, when the light emitting part 23 is used in an environment in which an ambient temperature is high, a component such as a capacitor disposed on a power source substrate part may be damaged, or detection accuracy may be lowered because service life of the light emitting element is shortened and luminous intensity varies. In the light receiving part 25, detection sensitivity by the light receiving element may vary when the user appropriately adjusts a degree of heat generation by the heating device 13. Due to this, fluctuations and variations may be caused in accuracy in one time of detection of excrement, or accuracy in continuous detection of excrement over time.

4. Arrangement Position of Detection Device

Subsequently, the following describes an arrangement position of the detection device with reference to FIG. 2 to FIG. 5.

The detection device 15 is arranged at a position not opposed to the rim water discharge port 9*a*. For example, as illustrated in FIG. 2, in a case in which the rim water discharge port 9*a* is disposed on a left side in a left and right direction of the toilet bowl 7, the detection device 15 is arranged on a right side in the left and right direction of the toilet bowl 7. Thus, washing water discharged from the rim water discharge port 9*a* can be prevented from splashing on the detection device 15.

If a waterdrop adheres to the lens 26 of the detection device 15, detection accuracy for excrement by the detection device 15 may be lowered due to diffuse reflection of light or attenuation of light intensity that is caused when reflected light from the excrement passes through the waterdrop, or due to fur precipitated when the waterdrop is dried. With the arrangement position described above, it is possible to reduce the possibility that the sensitivity of the detection device 15 is adversely affected by the washing water discharged from the rim water discharge port 9*a*.

The arrangement position of the detection device 15 is not limited to the arrangement example described above so long as the washing water discharged from the rim water discharge port 9*a* does not splash on the detection device 15. Thus, for example, as illustrated in FIG. 3, in a case in which the rim water discharge port 9*a* disposed on the right side in the left and right direction of the toilet bowl 7 discharges the washing water toward a rear side of the toilet bowl, the detection device 15 may be arranged to be closer to a front side of the toilet bowl than the rim water discharge port 9*a* on the right side in the left and right direction of the toilet bowl 7.

As illustrated in FIG. 5, the light emitting parts 23 and the light receiving part 25 included in the detection device 15 are arranged to project from the toilet seat bottom plate 17 via the recessed part 17*a* disposed on the toilet seat bottom plate 17. Due to this, a distance between the heating device 13 and each of the light emitting parts 23 and the light receiving part 25 can be sufficiently long. Thus, it is possible to reduce the possibility that the heat generated by the heating device 13 adversely affects the light emitting parts 23 and the light receiving part 25.

As illustrated in FIG. 4, the detection device 15 is arranged on an inner side than the inner periphery of the rim part 9. More specifically, the detection device 15 is arranged along the inner peripheral part 11*b* of the toilet seat upper plate 11. The toilet seat 5 has a shape partially projecting toward an inner side with respect to the inner periphery of the rim part 9, so that, by arranging the detection device 15 along the inner peripheral part 11*b* of the toilet seat upper plate 11, the light emitting part 23 and the light receiving part 25 included in the detection device 15 can be arranged to project downward with respect to the upper surface of the rim part 9. Due to this, a distance between the heating device 13 and each of the light emitting parts 23 and the light receiving part 25 can be more sufficiently long. Additionally, the detection device 15 is arranged on the inner side with respect to the inner peripheral surface of the rim part 9, so that the washing water turning along the inner peripheral surface of the rim part 9 can be prevented from easily splashing on the detection device 15. Thus, it is possible to further reduce the possibility that the heat generated by the heating device 13 adversely affects the light emitting parts 23 and the light receiving part 25.

As illustrated in FIG. 5, the detection device 15 is hooked on a rim part 17*b* formed on an inner peripheral surface of the recessed part 17*a*. Specifically, part of the detection device 15 is hung on the rim part 17*b* to be hooked thereon. Due to this, the detection device 15 is configured to be detachable with from the rim part 17*b*. With a configuration in which a cover that can screen the recessed part 17*a* can be hooked on the rim part 17*b* in a case of not mounting the detection device 15 on the rim part 17*b*, the toilet seat bottom plate 17 can be made uniform regardless of presence/absence of the detection device 15.

5. Data Analysis

Figure 7:
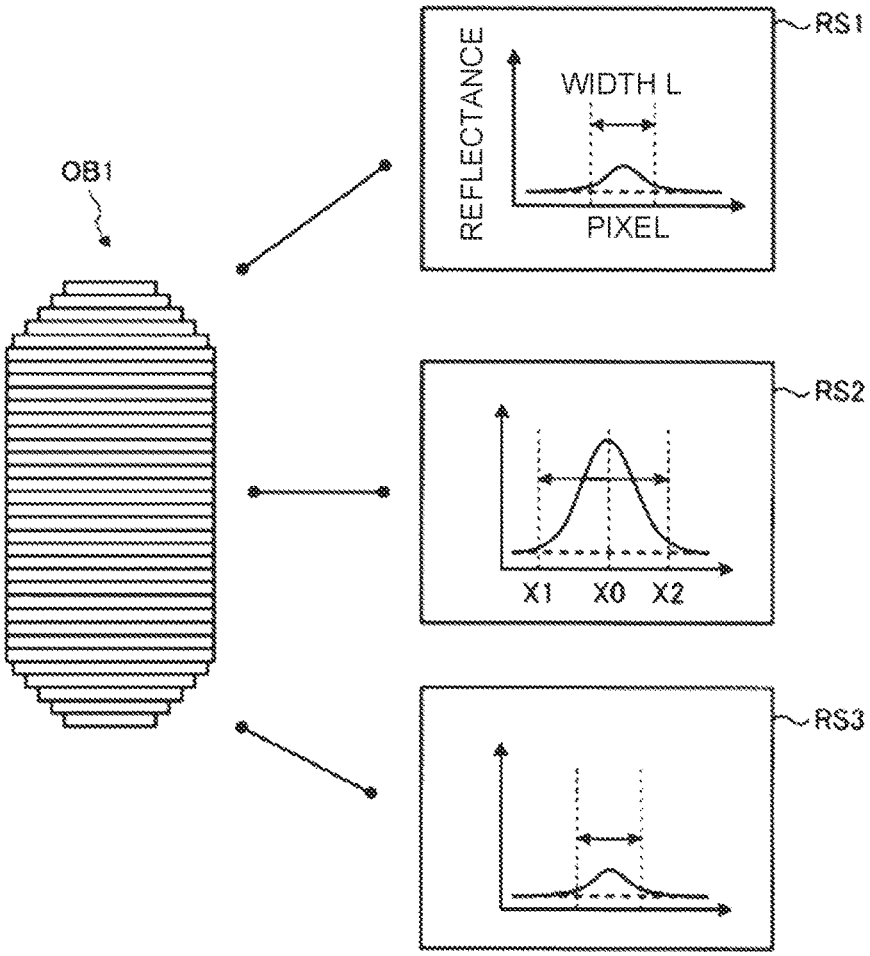
FIG. 7 is a diagram illustrating an example of data analysis of a shape of excrement.
Figure 8:
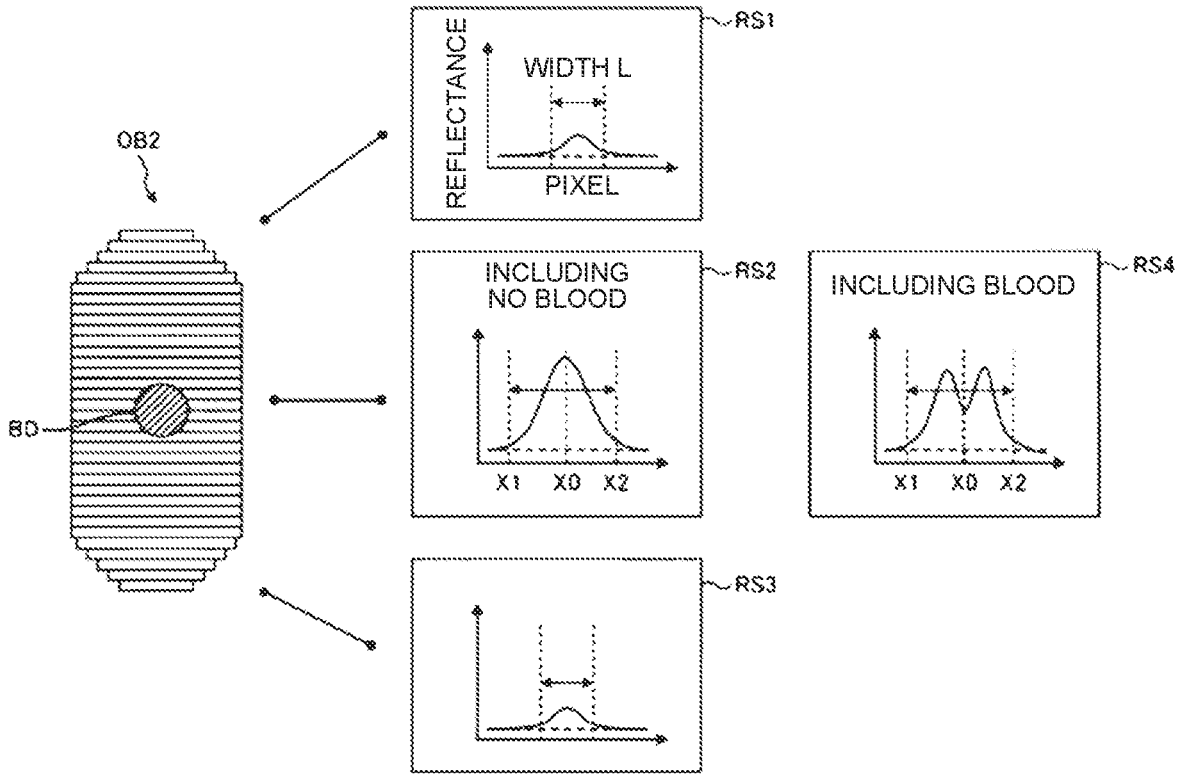
FIG. 8 is a diagram illustrating an example of data analysis of a color of excrement.

The following describes data analysis related to properties such as a shape and a color of the excrement (feces) detected by the detection device with reference to FIG. 7 and FIG. 8. The following describes a case in which a control device disposed in the functional part 3 performs processing of data analysis related to the shape and the color of the excrement (feces) by way of example. The data analysis may be performed by an external device (not illustrated) that is connected to the toilet seat device 2 or the detection device 15 in a wired or wireless manner.

5-1. Shape of Excrement

First, the following describes data analysis related to the shape of the excrement with reference to FIG. 7. FIG. 7 is a diagram illustrating an example of data analysis of the shape of the excrement.

An object OB1 in FIG. 7 schematically indicates the excrement (feces) as a detection target, and the following describes an outline of how the shape of the excrement is measured by using the object OB1 as an example. In the following description, a longitudinal direction of the object OB1 is assumed to be an upper and lower direction, and a direction orthogonal to the longitudinal direction (lateral direction) is assumed to be a horizontal direction. The object OB1 falls in a direction along the upper and lower direction.

Each of measurement results RS1 to RS3 is a graph indicating a reflectance of reflected light from the excrement detected by each pixel included in the light receiving element. Each of the measurement results RS1 to RS3 indicates a measurement result corresponding to each position in the upper and lower direction of the object OB1. The measurement result RS1 indicates a measurement result corresponding to an upper end part of the object OB1. The measurement result RS2 indicates a measurement result corresponding to a center part in the upper and lower direction of the object OB1. The measurement result RS3 indicates a measurement result corresponding to a lower end part of the object OB1.

The control device disposed in the functional part 3 detects presence/absence of a reflectance of each pixel received by the light receiving element. The control device obtains a peak value from pixels each having a reflectance. In each of the measurement results RS1 to RS3, center portions are the peak value. For example, in the measurement result RS2, the control device specifies that a pixel X0 is a pixel having the peak value.

When the control device compares differences in reflectances of the pixel having the peak value and an adjacent pixel, and in a case in which a reflectance equal to or larger than a predetermined value or equal to or smaller than the predetermined value is confirmed, the control device estimates that the light is reflected light from the excrement. The control device performs the same processing about a color.

In a case of confirming that the light is the reflected light from the excrement, the control device further performs the same processing on a pixel adjacent to the former pixel. Due to this, the control device grasps an end of the excrement, and estimates a width of the excrement. For example, in the measurement result RS2, the control device estimates that a range from a pixel X1 to a pixel X2 is the excrement. In the measurement result RS1, the control device estimates that a width L narrower than the range from the pixel X1 to the pixel X2 in the measurement result RS2 is the width of the excrement. The control device analyzes the shape of the excrement by stacking the measurement results RS1 to RS3 or the like. In the example of FIG. 7, the control device analyzes the shape such that the portion corresponding to the measurement result RS2 (center part) has the largest width, and the width is reduced as being closer to the portion corresponding to the measurement result RS1 (upper end part) or the portion corresponding to the measurement result RS3 (lower end part).

Through the processing described above, the toilet seat device 2 detects the object OB1 falling from the user toward the bowl part 8 of the toilet bowl 7. For example, the lower end part, the center part, and the upper end part of the object OB1 as falling excrement pass through the front side facing the light emitting part 23 and the light receiving part 25 in this order, and the object OB1 is detected from bottom top. Specifically, the object OB1 as falling excrement is detected in order of the measurement result RS3, the measurement result RS2, and the measurement result RS1. Due to this, the toilet seat device 2 can detect the excrement (feces) falling from the user. The toilet seat device 2 may detect the excrement submerged in sealing water in the bowl part 8 instead of the falling excrement.

5-2. Color of Excrement

First, the following describes data analysis related to a color of the excrement with reference to FIG. 8. FIG. 8 is a diagram illustrating an example of data analysis of a color of the excrement. The same point as that in FIG. 7 is denoted by the same reference numeral, for example, and the description thereof will be appropriately omitted.

An object OB2 in FIG. 8 indicates virtual excrement (feces), and is different from the object OB1 in FIG. 7 in that the object OB2 includes a blood region BD at the center part. The measurement results RS1 to RS3 illustrated in FIG. 8 correspond to the measurement results RS1 to RS3 of the object OB1 in FIG. 7 not including the blood region BD.

The control device specifies a pixel having a peak value with respect to light at a wavelength having a characteristic reflectance for blood in light emitted to the object OB2 as the excrement. For example, the control device specifies a pixel having a peak value with respect to light including a wavelength of 670 nm having a characteristic reflectance for blood in the light emitted to the object OB2 as the excrement.

Thereafter, the control device calculates a reflectance with respect to light at another wavelength detected by the pixel having the peak value. The control device estimates a color based on a ratio of the reflectance with respect to the other wavelength including 670 nm detected by the above pixel. A measurement result RS4 illustrated in FIG. 8 indicates a measurement result for a point including the blood region BD like the object OB2. For example, the measurement result RS4 illustrated in FIG. 8 indicates a measurement result in a case of emitting light not including 670 nm to the portion including the blood region BD of the object OB2.

The wavelength having a characteristic reflectance for blood is not limited to 670 nm, but may fall within a range from 600 nm to 800 nm. This is because, in a case in which blood adheres to the feces, a reflectance with respect to the color of the blood is more obviously detected than the color of the feces in this wavelength band.

Figure 9:
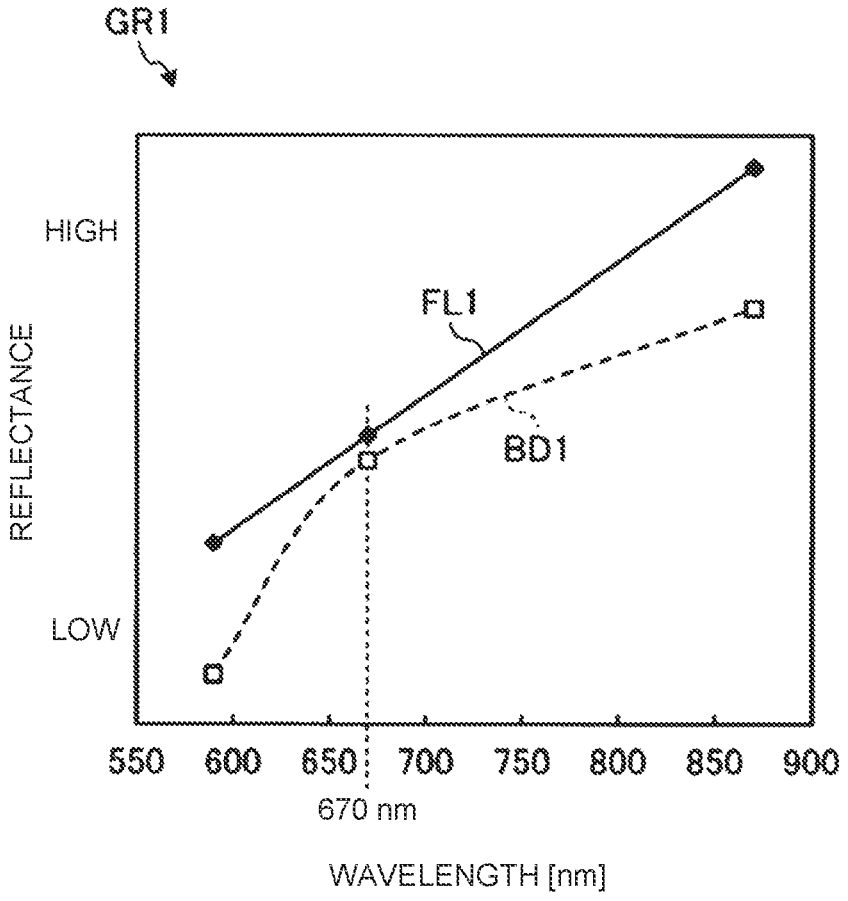
FIG. 9 is a diagram illustrating an example of a relation between excrement and blood.

The following describes a relation between the excrement and the blood with reference to FIG. 9. FIG. 9 is a diagram illustrating an example of the relation between the excrement and the blood. A graph GR1 illustrated in FIG. 9 is a diagram illustrating a relation between reflection of the feces and reflection of the blood adhering to the feces for each wavelength.

A line FL1 in the graph GR1 in FIG. 9 indicates a reflectance for each wavelength (about 600 nm to about 870 nm) with respect to the excrement (feces). As indicated by the line FL1 in FIG. 9, in a case of the excrement (feces), the reflectance is increased as the wavelength becomes longer. As indicated by the line FL1 in FIG. 9, in a case of the excrement (feces), a reflectance in the vicinity of 600 nm is the lowest, and a reflectance in the vicinity of 870 nm is the highest. A line BD1 in the graph GR1 in FIG. 9 indicates a reflectance for each wavelength (about 600 nm to about 870 nm) with respect to the blood adhering to the feces. As indicated by the line BD1 in FIG. 9, in a case of the blood adhering to the feces, a difference between the reflectance in the vicinity of 670 nm and the line FL1 becomes the smallest, and the difference between the reflectance and the line FL1 becomes larger with distance from 670 nm.

In the graph GR1 in FIG. 9, a ratio of the reflectance of the blood adhering to the feces to the reflectance of the feces becomes the largest in the vicinity of 670 nm, and becomes smaller with distance from 670 nm. In this way, in the graph GR1 illustrated in FIG. 9, the ratio of the reflectance of the blood adhering to the feces to the reflectance of the feces is large at the wavelength of 670 nm, and the ratio of the reflectance of the blood to the reflectance of the feces is small at the wavelength of 870 nm.

Figure 10:
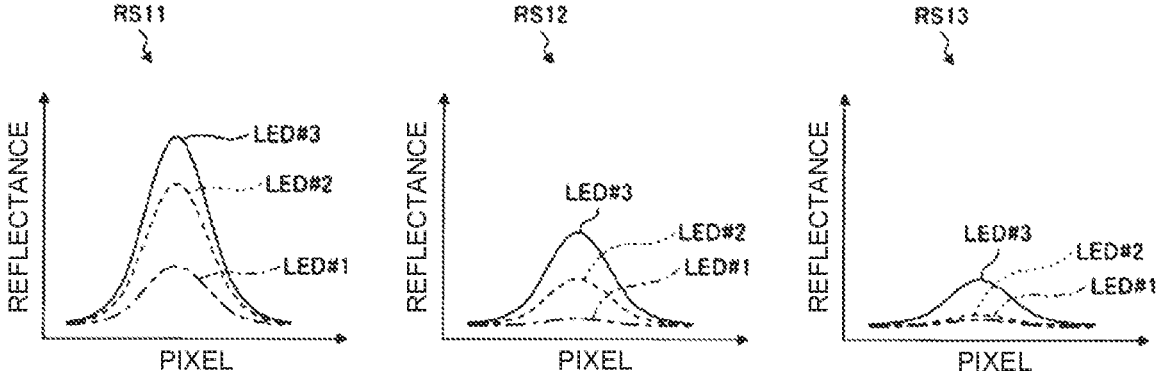
FIG. 10 is a diagram illustrating an example of data analysis of a color of excrement.
Figure 11:
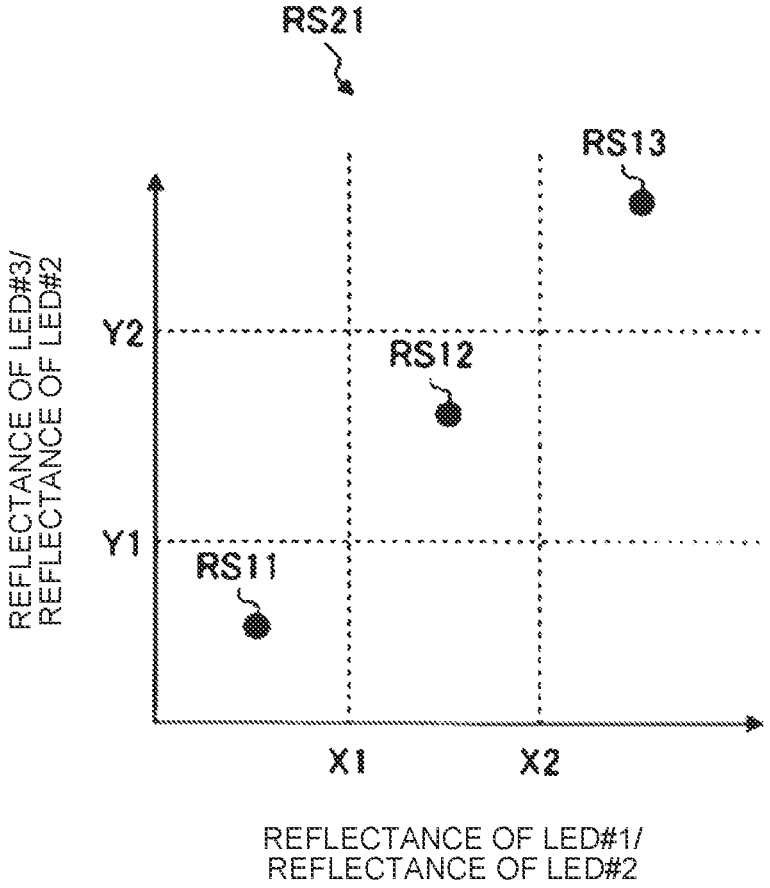
FIG. 11 is a diagram illustrating an example of data analysis of a color of excrement.

Thus, the toilet seat device 2 can detect the blood adhering to the excrement (feces) based on the ratio between reflectances at each wavelength as described above. The toilet seat device 2 can also analyze the color of the excrement based on the ratio between reflectances at each wavelength as described above. This point is described below with reference to FIG. 10 and FIG. 11. FIG. 10 and FIG. 11 are diagrams illustrating an example of data analysis of the color of the excrement.

Measurement results RS11 to RS13 illustrated in FIG. 10 indicate measurement results in a case in which pieces of excrement (feces) of different colors are set as measurement targets. For example, the color of the excrement (feces) as the measurement target may become darker in order of the measurement results RS11, RS12, and RS13. For example, the measurement result RS11 may be a measurement result of ocher excrement (feces), the measurement result RS12 may be a measurement result of brown excrement (feces), and the measurement result RS13 may be a measurement result of dark brown excrement (feces).

Each of LED #1, LED #2, and LED #3 indicated by the measurement results RS11 to RS13 in FIG. 10 is a light emitting element that emits light, and each curve of LED #1, LED #2, and LED #3 indicates a relation between the pixel and the reflectance. Each of LED #1, LED #2, and LED #3 may be a light emitting element that emits light in any wavelength region.

For example, as the color of the feces is darker, the reflectance with respect to each wavelength becomes smaller. In the example of FIG. 10, among the measurement results RS11 to RS13, in the measurement result RS13 in which the color of the excrement (feces) is the darkest, the reflectance with respect to each wavelength becomes small and the ratio of each reflectance becomes large.

On the other hand, for example, as the color of the feces becomes lighter, the reflectance with respect to each wavelength becomes larger. In the example of FIG. 10, among the measurement results RS11 to RS13, in the measurement result RS11 in which the color of the excrement (feces) is the lightest, the reflectance with respect to each wavelength becomes large and the ratio of each reflectance becomes small. For example, as the color becomes lighter, light at each wavelength is more strongly reflected, so that a difference between reflectances at respective wavelengths becomes small.

Thus, the toilet seat device 2 can classify the color of the excrement (feces) by performing analysis based on a relevance between the wavelength and the reflectance as described above. For example, the toilet seat device 2 classifies the color of the excrement (feces) in each measurement process by classifying the measurement results RS11 to RS13 based on the ratio of the reflectance with respect to each of LED #1, LED #2, and LED #3 as in a classification result RS21 illustrated in FIG. 11.

For example, the toilet seat device 2 classifies the color of the excrement (feces) in each of the measurement results RS11 to RS13 by using a ratio between the reflectance of LED #1 and the reflectance of LED #2, or a ratio between the reflectance of LED #3 and the reflectance of LED #2. For example, assuming that "reflectance of LED #1/reflectance of LED #2" is the X-axis and "reflectance of LED #3/reflectance of LED #2" is the Y-axis, the toilet seat device 2 classifies the color of the excrement (feces) in each measurement process in accordance with a position of each of the measurement results RS11 to RS13. For example, in a case in which the ratio is smaller than X1 in the X-axis direction and smaller than Y1 in the Y-axis direction, the toilet seat device 2 classifies the color of the excrement (feces) in this measurement process into "ocher". For example, in a case in which the ratio is equal to or larger than X1 and smaller than X2 in the X-axis direction, and equal to or larger than Y1 and smaller than Y2 in the Y-axis direction, the toilet seat device 2 classifies the color of the excrement (feces) in this measurement process into "brown". For example, in a case in which the ratio is equal to or larger than X2 in the X-axis direction and equal to or larger than Y2 in the Y-axis direction, the toilet seat device classifies the color of the excrement (feces) in this measurement process into "dark brown". The above method is merely an example, and the toilet seat device 2 may classify the color of the excrement (feces) in each measurement process by using any method.

6. Another Configuration of Toilet Seat Device

Figure 12:
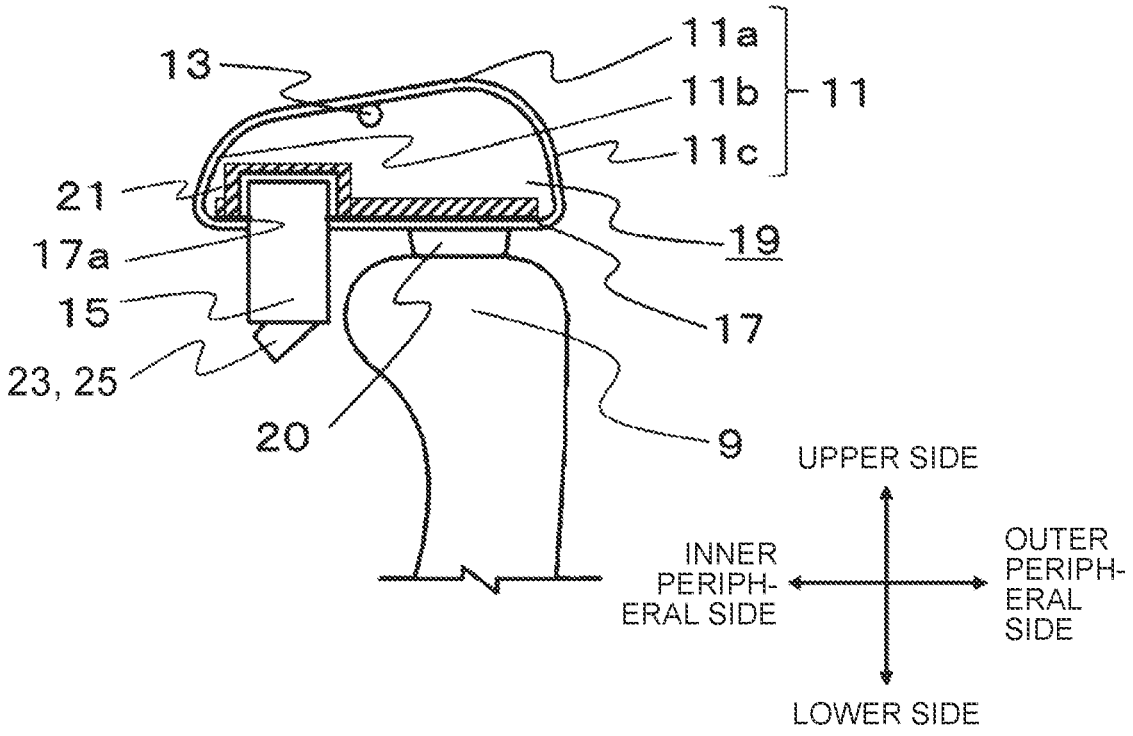
FIG. 12 is a diagram illustrating an example of a toilet seat device having another configuration.

The configuration of the toilet seat device 2 described above is merely an example, and the configuration of the toilet seat device 2 is not limited thereto. An opening may be formed on the toilet seat bottom plate 17 of the toilet seat device 2. For example, the toilet seat device 2 may have an opening 17*a* disposed on the toilet seat bottom plate 17 in place of the recessed part 17*a* of the toilet seat bottom plate 17. For example, the opening 17*a* communicates with an internal space of the toilet seat 5 and an external space. The toilet seat device 2 having this configuration is described below with reference to FIG. 12. FIG. 12 is a diagram illustrating an example of the toilet seat device having another configuration. For example, FIG. 12 is an enlarged view of a cross section of the toilet seat device 2 having the opening 17*a* in place of the recessed part 17*a*, viewed along the line A-A in FIG. 2. The configuration of the toilet seat device 2 illustrated in FIG. 12 is the same as the configuration of the toilet seat device 2 described above except that the recessed part 17*a* is the opening 17*a*, so that description about the same point as that in the above description will be appropriately omitted.

In the example of FIG. 12, a clearance is disposed between the detection device 15 and the heat transfer suppressing means 21 formed of an insulating material. The clearance herein is a space filled with air, for example. A region surrounded by the heat transfer suppressing means 21, the toilet seat bottom plate 17, and the detection device 15 in FIG. 12 corresponds to the clearance between the heat transfer suppressing means 21 and the detection device 15. In this way, in the example of FIG. 12, the clearance is disposed between the heating device 13 and the heat transfer suppressing means 21 formed of the insulating material, and between the heat transfer suppressing means 21 and the detection device 15. The clearance between the heat transfer suppressing means 21 and the detection device 15 preferably has a size equal to or larger than 0.3 mm. That is, a distance between the heat transfer suppressing means 21 and the detection device 15 is preferably equal to or longer than 0.3 mm. The heat transfer suppressing means 21 formed of the insulating material is installed at a position closer to the detection device 15 than the heating device 13.

In the example of FIG. 12, the detection device 15 is arranged so that part of the detection device 15 projects from the toilet seat bottom plate 17 and the rest thereof is embedded inside the toilet seat 5. In this way, the detection device 15 is arranged to pass through the opening 17*a* so that part of the detection device 15 projects from the toilet seat bottom plate 17 and the rest thereof is embedded inside the toilet seat 5. Additionally, a length in a height direction of the part of the detection device 15 embedded inside the toilet seat 5 is shorter than a distance between the heating device 13 and the detection device 15. In the example of FIG. 12, a distance between an upper surface of the detection device 15 and a bottom surface of the toilet seat bottom plate 17 is shorter than the shortest distance between the heating device 13 and the detection device 15.

The embodiment and modifications described above can be appropriately combined with each other in a range of causing no contradiction between pieces of processing content.

According to an aspect of the embodiment, it is possible to reduce the possibility that the heat generated by the heating device that heats the toilet seat adversely affects the detection device for optically detecting excrement disposed in the toilet seat.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A toilet seat device configured to be attached to an upper part of a closet bowl on which a bowl part for receiving excrement is formed, the toilet seat device comprising:

a toilet seat upper plate constituting a seating surface on which a user sits;

a toilet seat bottom plate joined with the toilet seat upper plate to be opposed to the closet bowl;

a heating device disposed between the toilet seat upper plate and the toilet seat bottom plate to heat the toilet seat upper plate;

a detection device disposed on a toilet seat to optically detect the excrement, wherein the detection device is arranged in a non-contact manner with respect to the heating device; and insulating material is arranged between the heating device and the detection device, wherein a first air layer is disposed between the insulating material and the heating device, wherein a second air layer is disposed between the insulating material and the detection device, and wherein the insulating material is held in a non-contact state with respect to both the heating device and the detection device by the first air layer and the second air layer.

2. The toilet seat device according to claim 1, wherein the heating device is not disposed right above the detection device.

3. The toilet seat device according to claim 1, wherein the detection device is arranged so that part of the detection device projects from the toilet seat bottom plate and the rest of the detection device is embedded inside the toilet seat.

4. The toilet seat device according to claim 3, wherein a length in a height direction of the part of the detection device embedded inside the toilet seat is shorter than a distance between the heating device and the detection device.

5. A closet bowl device comprising:

a rim water discharge port configured to discharge washing water along a rim part of the closet bowl;

the closet bowl; and the toilet seat device according to claim 1 attached to an upper part of the closet bowl.

6. The closet bowl device according to claim 5, wherein the detection device is arranged at a position not opposed to the rim water discharge port.

7. The closet bowl device according to claim 5, wherein the detection device is arranged along an inner peripheral part of the toilet seat upper plate.

* * * * *